United States Patent [19]

Stolz

[11] 3,994,145

[45] Nov. 30, 1976

[54] KNITTING-MACHINE NEEDLE

[75] Inventor: Fritz Stolz, Peseux, Switzerland

[73] Assignee: Agula S.A., Neuchatel, Switzerland

[22] Filed: Jan. 29, 1975

[21] Appl. No.: 545,203

[30] Foreign Application Priority Data

Feb. 5, 1974 Switzerland ..... 1570/74

[52] U.S. Cl. ..... 66/123; 66/121

[51] Int. Cl.[2] ..... D04B 35/02

[58] Field of Search ..... 66/119, 120, 121, 123, 66/124

[56] References Cited

UNITED STATES PATENTS

| | | | |
|---|---|---|---|
| 78,506 | 6/1868 | Aiken | 66/123 |
| 423,244 | 3/1890 | Harley et al. | 66/123 |
| 589,024 | 8/1897 | Philbrick | 66/123 |
| 885,590 | 4/1908 | Egly | 66/123 |
| 1,188,124 | 6/1916 | Williams | 66/123 |
| 2,010,205 | 8/1935 | Swinglehurst | 66/123 |
| 2,344,850 | 3/1944 | Cole | 66/121 |
| 3,220,221 | 11/1965 | Sheeler | 66/121 |
| 3,423,962 | 1/1969 | Peberdy | 66/121 |
| 3,874,199 | 4/1975 | Mayer et al. | 66/123 |
| 3,875,767 | 4/1975 | Kopal et al. | 66/123 |

FOREIGN PATENTS OR APPLICATIONS

| | | | |
|---|---|---|---|
| 2,133,366 | 12/1972 | Germany | 66/123 |
| 47-7746 | 5/1968 | Japan | 66/120 |
| 23,626 | 11/1921 | United Kingdom | 66/123 |

*Primary Examiner*—Mervin Stein
*Assistant Examiner*—A. M. Falik
*Attorney, Agent, or Firm*—Toren, McGeady and Stanger

[57] ABSTRACT

A knitting machine needle is divided into a hook portion, a shank portion, and a butt portion. The shank portion has a front section of constant width and a rear section that has at least one undulation, also of constant width.

6 Claims, 2 Drawing Figures

KNITTING-MACHINE NEEDLE

BACKGROUND OF THE INVENTION

This invention relates to a knitting-machine needle comprising a hook portion, a shank portion, and a butt portion, the shank portion having a straight, tapering front section contiguous with the hook portion and a rear section of uniform width contiguous with the butt portion.

Knitting-machine needles of this kind are used particularly in circular knitting machines intended for manufacturing stockings, for example, and working continuously. The needles are mounted in grooves of a needle bed, and control means impart to them a programmed forward-and-backward movement, each needle being moved in turn during the rotation of the carriage.

Needles of this kind must meet contradictory requirements in the sense that, while their dimensions should be as fine as possible, they must nevertheless possess good resistance to the considerable stresses to which they are subjected. Moreover, the main dimensions of the needles, especially their overall length, their thickness, and the distance by which the shank projects from the needle bed in its forwardmost position, are governed by the structure of the knitted fabric and are, consequently, obligatory.

Thus the contradictory requirements mentioned above, plus the fact that efforts are constantly being made to increase the speed at which the machines operate, oblige the manufacturers of needles to seek new designs which enable users of these highspeed machines to get the most out of them. In order to make the needle lighter, especially the rearward portion of it, while still ensuring satisfactory guidance of the butt in the groove in which the needle is engaged, the tendency has been to reduce the width of the butt to a certain extent and to provide needles having a trapezoidal zone at the base of the butt. However, this improvement has not remedied one drawback which appears in the machines operating at the highest speeds to be found at the present time. This drawback is the vibration of the hook after the forward thrust of the needle and after its rapid return backwards, which vibration causes breakage of the hook after some time.

SUMMARY OF THE INVENTION

It is the object of this invention to remedy that drawback by providing a needle design which meets the required conditions, especially as concerns the length of the shank and the width of its rear portion.

To this end, in the needle according to the present invention, at least part of the rear section of the shank portion curves along an undulating line.

BRIEF DESCRIPTION OF THE DRAWING

Two possible embodiments of the invention will now be described in detail with reference to the accompanying drawing, in which.

DETAILED DESCRIPTION OF THE INVENTION

Figures 1, 2:
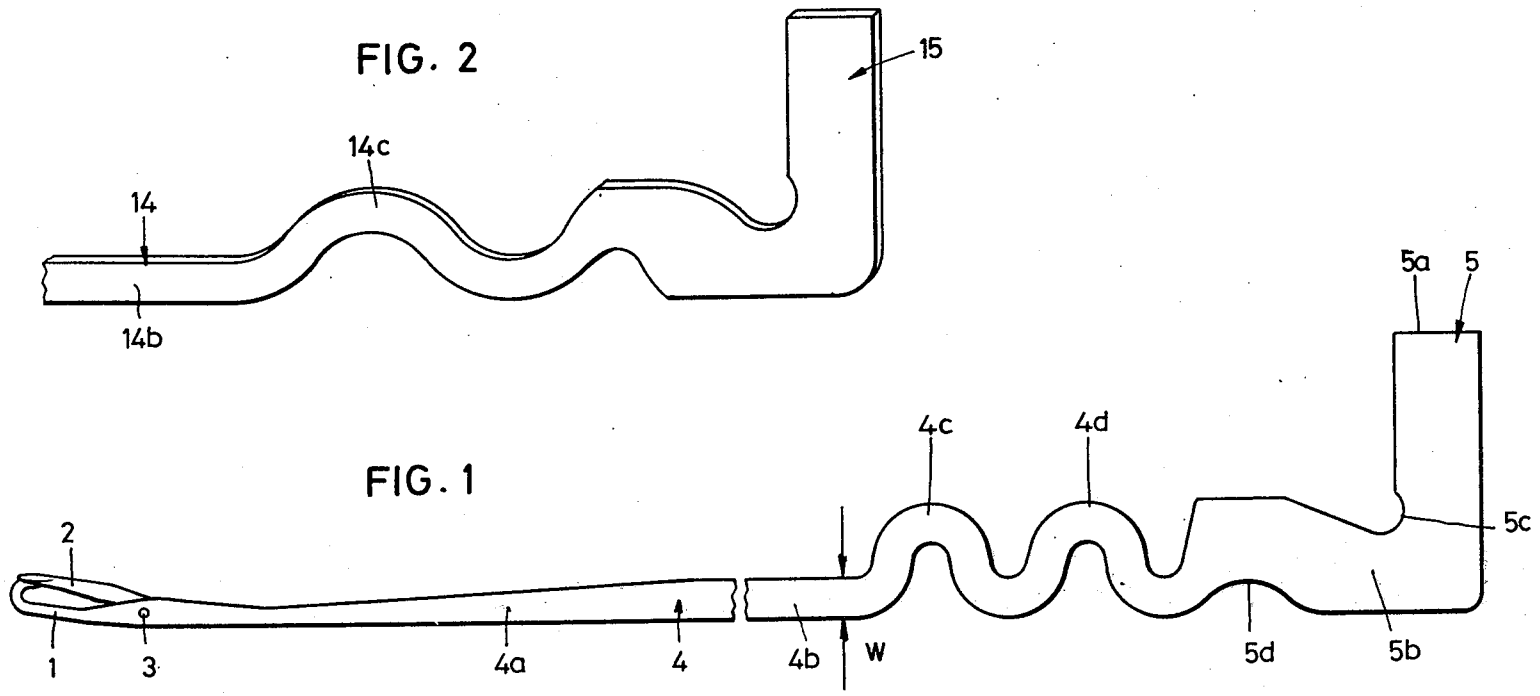
FIG. 1 is a plan view of a first embodiment of the needle.
FIG. 2 is a perspective view of the rear portion of the needle in a second embodiment.

FIG. 1 shows a hook 1 equipped with a latch 2 pivoting at the rearward end of the hook 1 about an axis 3, and a shank 4 having a front section 4*a* which gradually increases in width towards the rear and a rear section 4*b* of uniform width *W*. Also shown are a butt 5 comprising a rectangular upright 5*a* and a base 5*b* limited by a first edge perpendicular to the upright 5*a* and a second edge which runs first at a slant from the base of the upright 5*a* and then parallel to the longitudinal axis of the needle. The butt 5 has a shallow notch 5*c* at the base of the upright 5*a* and a deeper notch 5*d* at the forward end of the base 5*b* in the projection of the edge which is perpendicular to the upright 5*a*. In a reduction of the invention to practice, the needle has an overall length of about 71 mm, and the part of the shank which is intended to extend beyond the needle bed when in advanced position measures 50 mm. starting from the end of the hook. Since the total length of the butt is on the order of 10 mm. in order to ensure the rigidity and guidance of the needle, it will be seen that there remains a distance of about 11 mm. between the front end of the butt and the borderline of the part which is to extend beyond the needle bed.

As may be seen in FIG. 1, this rearmost portion of the shank 4 curves along an undulating line, forming two undulations 4*c* and 4*d*. The contour of the undulations 4*c* and 4*d* is formed by arcs joining one another tangentially at the median axis of the undulations. The radius of the arcs generated by rotating the center line of the shank 4 is approximately equal to the width of the rear section 4*b* of the shank 4. Thus, for example, in a practical model where the rear section of the shank measures 1.4 mm. in width, the radius of the inner edge of the undulation 4*c* is 0.6 mm., while the radius of its outer edge is 2 mm. Hence the two undulations occupy the 11-mm.-long space between the end of the butt and the straight portion of the shank, and the length of the undulating portion is approximately equal to one-fifth the length of the part intended to extend beyond the needle bed.

In FIG. 2, a butt 15 is of approximately the same size and shape as the butt 5 of FIG. 1, and the rearmost portion of a shank 14 contiguous with the butt 15 likewise has an undulating form for a length of about 11 mm. In this undulating zone, the width of the shank 14 is the same as in the straight portion of its rear section 14*b*, but the arcs which determine the shape of the undulating zone are larger than in the first embodiment, so that the undulating zone comprises only one undulation, 14*c*.

In both embodiments, the needle has a thickness of a few tenths of a millimeter throughout its length. It may be produced by two different methods.

According to the first method, the starting material is a piece of steel wire of a predetermined diameter. The portion of this piece of wire which is intended to form the shank as a whole is subjected to a drawing operation which greatly reduces its diameter. The rearmost portion of the shank is then bent to form the undulations described above. The rear portion of the butt may also be bent, after which the entire body of the needle is pressed until the aforementioned thickness is achieved. Lastly, the butt is given its final shape by a blanking operation.

According to the second method, the starting material is once more a piece of wire as in the first method, but only the part intended to form the straight portion of the shank is drawn. The second operation is then that of flattening in the press; and during the blanking operation, not only the butt but also the rearmost portion of the shank with the undulations is blanked.

The trials carried out with needles according to FIGS. 1 and 2 have shown that the breakages of the hook which occurred with needles of the same dimensions, but not provided with the undulations 4*c* and 4*d* or 14*c*, when they were used on very highspeed machines, no longer occurred with the needles described above. This unexpected result has made is possible to effect an appreciable increase in the speed of the machines in service and, consequently, to increase their output.

The effect produced by the undulations likewise derives from improved guidance of the needle, and it will be seen that this is obtained without weighing down the butt. The needle may be made of ordinary steel of the same type as is currently used for the known needles, so that the cost-price of the needle remains substantially unchanged.

Thus the arrangement described makes it possible to provide circular knitting machines rotating even more rapidly than has hitherto been possible and consequently having a greater output.

What is claimed is:

1. A knitting machine needle comprising a first end and a second end, a hook formed at said first end, a butt formed at said second end, and a shank portion formed between said hook and said butt, said shank portion comprising a first section extending from said hook having a tapered width increasing from said hook toward said butt, and a second section of uniform width, said second section comprising a straight portion having a first end connected to said first section and a second end, and an undulating portion having at least one undulation therein having a first end connected to said second end of said straight portion and a second end connected to said butt, said butt having an L-shape and a width greater than said uniform width, said undulating portion having an overall length approximately equal to one-fifth of the total combined length of said hook, said first section, and said straight portion.

2. The knitting machine needle according to claim 1, wherein said undulating portion comprises one undulation, said one undulation having an arc-shape and said first end of said undulating portion connected tangentially to said second end of said straight portion.

3. The knitting machine needle according to claim 2, wherein said butt comprises an extension for connecting said butt with second end of said undulating portion, said second end of said undulating portion being connected tangentially to said extension, said one undulation having an inner radius and and outer radius forming the uniform width of said undulating portion.

4. The knitting machine needle according to claim 1, wherein said undulating portion comprises two undulations, each of said two undulations having an arc-shape.

5. The knitting machine needle according to claim 4, wherein each of said two undulations comprises a first end and a second end, said first end of one of said undulations being connected tangentially to said second end of said straight portion and constituting said first end of said undulating portion, and said second end of the other of said two undulations being connected tangentially to said butt and constituting said second end of said undulating portion.

6. The knitting machine needle according to claim 5, wherein said second end of said one undulation and said first end of said other undulation are connected tangentially to each other, and each of said two undulations having an inner radius and an outer radius forming the uniform width of said undulating portion.

* * * * *